US007030066B1

(12) United States Patent
Piskoti

(10) Patent No.: US 7,030,066 B1
(45) Date of Patent: Apr. 18, 2006

(54) WETTING COMPOSITION FOR HIGH TEMPERATURE METAL SURFACES, AND METHOD OF MAKING THE SAME

(76) Inventor: Charles Piskoti, 10089 White Lake Rd., Fenton, MI (US) 48430

( * ) Notice: Subject to any disclaimer, the term of this patent is extended or adjusted under 35 U.S.C. 154(b) by 482 days.

(21) Appl. No.: 10/292,918

(22) Filed: Nov. 12, 2002

Related U.S. Application Data

(60) Provisional application No. 60/337,327, filed on Nov. 12, 2001.

(51) Int. Cl.
*C10M 155/00* (2006.01)
*C10M 159/12* (2006.01)

(52) U.S. Cl. ..... 508/202; 508/208

(58) Field of Classification Search ..... 508/202
See application file for complete search history.

(56) References Cited

U.S. PATENT DOCUMENTS 1,948,194 A 2/1934 Williams
2,045,913 A 6/1936 Hoy et al.
2,514,296 A 7/1950 Small et al.
2,788,296 A 4/1957 Louis
2,923,041 A 2/1960 Ryznar
3,258,319 A 6/1966 Cox
3,284,862 A 11/1966 Schweikert
3,294,725 A 12/1966 Findlay et al.
3,342,249 A 9/1967 Ulmer et al.
3,407,865 A 10/1968 Hammerton
3,413,390 A 11/1968 Heiss
3,423,503 A 1/1969 York
3,694,530 A 9/1972 Wolfe
3,848,037 A 11/1974 Harper
3,893,868 A 7/1975 Klement et al.
3,929,499 A 12/1975 Thomas
3,931,381 A 1/1976 Lindberg
3,959,242 A 5/1976 Watts et al.
3,968,302 A 7/1976 Brown
3,978,908 A 9/1976 Klaus et al.
3,992,502 A 11/1976 Krishnan
3,993,606 A 11/1976 VON Bonin et al.
4,002,794 A 1/1977 Schwarcz
4,028,120 A 6/1977 Emond
4,038,088 A 7/1977 White et al.
4,073,758 A 2/1978 Nakayama et al.
4,098,731 A 7/1978 Von Bonin et al.
4,098,929 A 7/1978 Badone et al.
4,110,397 A 8/1978 Wooler
4,119,547 A 10/1978 Nachtman et al.
4,130,698 A 12/1978 Sparrow et al.
4,131,662 A 12/1978 Cekoric et al.
4,147,821 A * 4/1979 Young ..... 427/295
4,172,870 A 10/1979 Whitchurch
4,184,880 A 1/1980 Huber et al.
4,195,002 A 3/1980 Radtke et al.
4,264,052 A 4/1981 Radtke et al.
4,308,063 A 12/1981 Horiuchi et al.
4,312,672 A 1/1982 Blahak et al.
4,331,736 A 5/1982 Schafer et al.
4,396,729 A 8/1983 Dominquez et al.
4,424,297 A 1/1984 Bey
4,427,803 A 1/1984 Fukui et al.
4,431,455 A 2/1984 Brown et al.
4,451,425 A 5/1984 Meyer
4,454,050 A 6/1984 Bertell
4,454,113 A 6/1984 Hemker
4,472,341 A 9/1984 Alberino et al.
4,473,403 A 9/1984 Wesala
4,491,607 A 1/1985 Wesala
4,495,226 A 1/1985 Smith
4,505,955 A 3/1985 Meddaugh
4,532,096 A 7/1985 Bogner et al.
4,534,928 A 8/1985 Martin
4,562,875 A 1/1986 Ogoshi et al.
4,568,718 A 2/1986 Huebner et al.
4,609,511 A 9/1986 Fischer et al.
4,621,068 A 11/1986 Hansen
4,752,428 A 6/1988 Williams et al.
4,770,827 A 9/1988 Fischer
4,778,624 A 10/1988 Ohashi et al.
4,783,296 A 11/1988 Fischer et al.
4,785,067 A 11/1988 Brumbill
4,787,993 A 11/1988 Nagahiro
4,797,445 A 1/1989 Piskoti
4,879,074 A 11/1989 Waku et al.
4,936,917 A 6/1990 Harakal et al.
4,955,424 A 9/1990 Takehisa et al.
4,962,153 A 10/1990 Liles
4,969,952 A 11/1990 Hattich et al.
4,972,030 A 11/1990 Bauman
5,013,808 A 5/1991 Piskoti
5,021,530 A 6/1991 Yamamoto et al.
5,028,366 A 7/1991 Harakal et al.
5,028,653 A 7/1991 Desmonceau et al.
5,034,446 A 7/1991 Kendall et al.
5,036,144 A 7/1991 Weiss
5,039,435 A 8/1991 Hanano
5,076,339 A 12/1991 Smith (Continued)

*Primary Examiner*—Ellen M. McAvoy
(74) *Attorney, Agent, or Firm*—Young & Basile, P.C.

(57) ABSTRACT

The specification discloses a wetting composition and method of making the same, the wetting composition comprising an aqueous carrier having dispersed therein a gelled polymer comprising one or more hydrocarbon-containing oils cross-linked by one or more cross-linking agents, wherein the one or more cross-linking agents have at least one functional group.

23 Claims, No Drawings

U.S. PATENT DOCUMENTS 5,112,543 A 5/1992 Thary
5,208,028 A 5/1993 Clement et al.
5,218,024 A 6/1993 Krug et al.
5,262,088 A 11/1993 Hill et al.
5,279,750 A 1/1994 Hanano
5,340,486 A 8/1994 Willoughby
5,348,998 A 9/1994 Ito et al.
5,400,921 A 3/1995 Smith, Jr. et al.
5,401,801 A 3/1995 Naganawa et al.
5,495,737 A 3/1996 Graham
5,525,640 A 6/1996 Gerkin et al.
5,584,201 A * 12/1996 Graham et al. ..... 72/42
5,587,197 A 12/1996 Maeda et al.
5,648,419 A 7/1997 Kendall
5,661,189 A 8/1997 Grieveson et al.
5,696,173 A 12/1997 Kendall
5,700,764 A 12/1997 Walters et al.
5,708,070 A 1/1998 Joffre et al.
5,861,459 A 1/1999 Cardinaud et al.
5,919,741 A 7/1999 Jaynes et al.
5,919,857 A 7/1999 Ruch et al.
6,004,616 A 12/1999 Maeda et al.
6,153,694 A 11/2000 Miyatake et al.
6,165,950 A 12/2000 Rao et al.
6,172,122 B1 1/2001 Lawate et al.
6,192,968 B1 2/2001 Renkl et al.
6,194,357 B1 2/2001 Murata et al.
6,194,510 B1 2/2001 Anderson et al.
6,214,928 B1 4/2001 Craig et al.
6,255,260 B1 7/2001 Stork
6,258,920 B1 7/2001 Starner et al.
6,291,407 B1 9/2001 Reidmeyer
6,291,597 B1 9/2001 Gruber et al.
6,372,160 B1 4/2002 Kendall

* cited by examiner

WETTING COMPOSITION FOR HIGH TEMPERATURE METAL SURFACES, AND METHOD OF MAKING THE SAME

RELATED APPLICATIONS

This application is related to, and claims the benefit of priority from, U.S. Provisional Patent Application Ser. No. 60/337,327, filed Nov. 12, 2001.

FIELD OF THE INVENTION

The present invention relates generally to wetting compositions, such as may be useful as wetting agents, lubricants and/or lubricant additives for metal casting and hot metal forming, for instance die casting, and more particularly to such wetting compositions comprising an aqueous carrier having dispersed therein a gelled polymer comprising one or more hydrocarbon-containing oils cross-linked by one or more cross-linking agents.

BACKGROUND

Effective high-temperature wetting has presented a significant challenge in the die casting field for some time. Conventional methods, such as disclosed in U.S. Pat. No. 6,192,968 issued to Renkl, comprise spraying the mold or die walls with a mixture of die-wall treatment agent and water each time a part is removed from the die. This application simultaneously cools the surface of the die walls and applies the treatment agent thereto. However, a drawback of this method is the so-called "Leidenfrost effect": When the droplets of spray land on the hot surface of the die wall, a vapor barrier forms between the droplets and the surface. This barrier prevents the droplets from completely wetting the surface. Some of the sprayed-on mixture of treatment agent and water therefore runs off the surface of the die wall without cooling, lubricating, or wetting it, thereby failing to impart the desired release properties. Because of this disadvantageous side-effect it is necessary in conventional practice, in order to both cool the die wall surface and coat it with an effective amount of a treatment agent, to apply an excess of the treatment agent/water mixture. This excess will run off the surface of the mold walls unused and then must be collected and disposed of. This may, in some instances, raise significant environmental concerns.

In addition to disposal concerns and the expense of applying excess treatment agent, it is undesirable to continually submit die surfaces to the extreme temperature variations occasioned by the application of the treatment agent/water mixture. The die itself is already subject to a very large temperature gradient in that the inner regions of the die may be at about 450° F., while the outer surface during operation may reach in excess of 1300° F. This temperature difference causes heat checking. Further, when a treatment-agent/water mixture is used to cool the die surface, the surface temperature may be lowered to between about 300° F. and 350° F. This may, in certain cases, exacerbate the heat checking to the point that the die produces parts outside of acceptable tolerances, thus effectively rendering the die useless (at least for the particular item being formed).

It is further undesirable to use excess lubricant for the reason that, during casting, the lubricants may be incorporated into cast parts, thereby potentially causing deformations, weak spots, and/or unpaintable/unfinishable spots.

Known wetting compositions include emulsions of methyl alkyl/methyl propyl-benzyl polysiloxane fluids, known as paintable silicone fluid emulsions. These fluids are those that are made from methyl-hydrogen silicone fluid. While paintable silicone fluid emulsions are effective at wetting surfaces up to about 800° F., they are expensive and tend to build up on the die surface.

In addition to the foregoing, it is also the case that applying an even film to high temperature surfaces on dies for casting of molten metals (e.g., die casting) and hot forming of metals has long been a problem. Most water-based substances that are used as parting agents for these operations, called mold, die or forging lubricants, do not wet the hottest areas of the die as well as the cooler areas. In areas of the die where the temperature exceeds 600° F., the wetting of most die lubricants is reduced. In areas of the die where the temperature exceeds 700° F., the wetting of most die lubricants is so poor that excessive quantities thereof must be sprayed onto the die so that the water carrier first reduces the temperature of the hot area, after which the lubricant forms a film. Excessive spraying of hot areas results is excessive deposition onto the cooler adjacent areas. Further, excessive lubrication application can cause buildup on the die surface.

Thus, it would be desirable to provide a wetting composition that effectively wets and/or lubricates a high temperature metal surface without having to apply an excess of the composition to the die surface, thus substantially eliminating waste and/or disposal concerns. It would further be desirable to provide such a composition which does not contain compounds deleteriously affecting either mechanical properties of a cast part, or finishing/painting operations upon the cast part. Still further, it would be desirable to provide such a composition which has, as its main ingredient, environmentally friendly compound(s) which are both abundant and relatively inexpensive.

SUMMARY OF THE DISCLOSURE

The specification describes an inventive wetting composition, and method of preparing the same, the wetting composition comprising an aqueous carrier having dispersed therein a gelled polymer comprising one or more hydrocarbon-containing oils cross-linked by one or more cross-linking agents, wherein the one or more cross-linking agents have at least one functional group.

According to one feature of this invention, the one or more cross-linking agents are selected from the group consisting of peroxides, silicates, siloxanes, silanes, hydrocarbon-containing oils, and mixtures thereof, preferably from the group consisting of peroxides, silicates, methyl and alkylaryl functional siloxanes, amine-functional silanes, organosilicone coplymers with Si—H functionality, and mixtures thereof, and more preferably from the group consisting of benzoyl peroxide, aminopropyltriethoxysilane, aminopropyltrimethoxysilane, (N-(2-aminoethyl)-3-(Aminopropyltrimethoxysilane), methylalkylaryl organosilicone coplymers having Si—H functionality, ethyl silicate, siloxanes having methyl and alkylaryl functional groups, and mixtures thereof.

Per still another feature, the one or more cross-linking agents comprise the following mixtures: Ethyl silicate, a siloxane having methyl and alkylaryl functional groups, and aminopropyltriethoxysilane; ethyl silicate, a siloxane having methyl and alkylaryl functional groups, and (N-(2-aminoethyl)-3-(Aminopropyltrimethoxysilane); and (N-(2-aminoethyl)-3-(Aminopropyltrimethoxysilane) and ethyl silicate.

Per yet another feature, the one or more hydrocarbon-containing oils comprise the following, including mixtures thereof: Vegetable oils such as jojoba, soybean, rice bran, avocado, almond, olive, sesame, persic, castor, coconut; fats such as beef tallow, lard and hardened oils obtained by hydrogenating the aforementioned oils; synthetic mono-, di- and tri-glycerides such as myristic acid glyceride and 2-ethylhexanoic acid glyceride; waxes such as carnuba, speimaceti, beeswax, lanolin and derivatives thereof; and hydrocarbons such as liquid paraffins, petrolatum, microcrystalline wax, ceresin, squalene, squalane, mineral oil, and polyethylene.

When combined with suitable oils, the composition of the present invention are suitable for application as lubricants, for instance as a plunger lubricant. Such a lubricating composition according to this embodiment of the present invention comprises an admixture of one or more emulsified hydrocarbon-containing oils and a gelled polymer comprising one or more hydrocarbon-containing oils cross-linked by one or more cross-linking agents, the one or more cross-linking agents having at least one functional group.

Per one feature of this inventive lubricant, the one or more cross-linking agents are selected from the group consisting of peroxides, silicates, siloxanes, silanes, hydrocarbon-containing oils, and mixtures thereof. According to one embodiment, the one or more cross-linking agents comprise (N-(2-aminoethyl)-3-(Aminopropyltrimethoxysilane), the one or more cross-linked hydrocarbon-containing oils comprise blown soybean oil, and the one or more emulsified hydrocarbon-containing oils comprise emulsified white oil and emulsified napthenic oil.

According to one embodiment of the method of the present invention, the wetting composition is prepared by the steps of:

Providing one or more hydrocarbon-containing oils and one or more cross-linking agents, wherein the one or more cross-linking agents have at least one functional group;

mixing the one or more hydrocarbon-containing oils and the one or more cross-linking agents;

emulsifying the mixture in water; and forming a gelled polymer dispersed in the aqueous carrier through cross-linking the one or more hydrocarbon-containing oils by the one or more cross-linking agents.

In an alternative embodiment, the wetting composition is prepared by the steps of:

Providing one or more hydrocarbon-containing oils and one or more cross-linking agents, wherein the one or more cross-linking agents have at least one functional group;

emulsifying the one or more hydrocarbon-containing oils in water;

emulsifying the one or more cross-linking agents in water;

mixing the emulsion of the one or more hydrocarbon-containing oils and the emulsion of the one or more cross-linking agents;

forming a gelled polymer dispersed in the aqueous carrier through cross-linking the one or more hydrocarbon-containing oils by the one or more cross-linking agents.

WRITTEN DESCRIPTION

The present invention provides a wetting composition, having particular, though not exclusive, utility as a die lubricant, and as a lubricant or lubricant additive for metal casting and hot metal forming.

The wetting composition most generally comprises an aqueous carrier having dispersed therein a gelled polymer comprising one or more hydrocarbon-containing oils cross-linked by one or more cross-linking agents. The composition is most generally prepared by emulsifying the one or more hydrocarbon-containing oils and one or more cross-linking agents in water, following which cross-linking takes place to produce a gelled polymer dispersed in the aqueous carrier.

The present invention is predicated upon the unexpected and surprising discovery that certain gelled polymers, dispersed in an aqueous carrier, provide superior wetting and/or lubricating characteristics when used on high temperature metal surfaces, including, for instance, dies used in the die casting industry.

Advantageously, the wetting composition of the present invention wets the die wall at high temperatures without the need to apply the composition in excess, as is the case with conventional compositions. Without being bound to any theory, it is believed that, after emulsification, the one or more hydrocarbon-containing oils react with the one or more cross-linking agents to form a gelled polymer having increased viscosity.

"High temperature" is defined herein to comprehend temperatures substantially at or above about 450° F., up to temperatures as high as about 950° F.

Forming the gelled polymer in the composition of the present invention is referred to herein synonymously as "gelling." "Gelling," as used herein, means and refers to the act of causing the cross-linking of the one or more hydrocarbon-containing oils by the one or more cross-linking agents, for instance by heating, as well as the act of allowing such cross-linking to occur at ambient conditions (e.g., at room temperature (approximately 25° C.)).

The cross-linking agents suitable for the present invention are most generally characterized by having at least one functional group, and more preferably two or more functional groups. As will be appreciated upon reference to the instant specification, cross-linking of the one or more hydrocarbon-containing oils may be accomplished by numerous mechanisms, including, without limitation, free-radical formation, hydrosilation reactions, acid-base reactions, etc. Without limitation, particularly suitable cross-linking agents include those selected from the group consisting of peroxides, silicates, siloxanes, silanes, hydrocarbon-containing oils, and mixtures thereof; more particularly those selected from the group consisting of peroxides, silicates, methyl and alkylaryl functional siloxanes, amine-functional silanes, organosilicone coplymers with Si—H functionality, and mixtures thereof; and even more particularly those selected from the group consisting of benzoyl peroxide, aminopropyltriethoxysilane (hereinafter also referred to as "AMEO"), aminopropyltiimethoxysilane (hereinafter also referred to as "AMMO"), (N-(2-aminoethyl)-3-(Aminopropyltrimethoxysilane)(hereinafter also referred to as "DAMO"), methylalkylaryl organosilicone coplymers having Si—H functionality, ethyl silicate, siloxanes having methyl and alkylaryl functional groups, and mixtures thereof.

Specific exemplary mixtures of cross-linking agents described herein include: Ethyl silicate, a siloxane having methyl and alkylaryl functional groups, and aminopropyltriethoxysilane, ethyl silicate, a siloxane having methyl and alkylaryl functional groups, and (N-(2-aminoethyl)-3-(Aminopropyltrimethoxysilane); and (N-(2-aminoethyl)-3-(Aminopropyltrimethoxysilane) and ethyl silicate.

Suitable hydrocarbon-containing oils include: Vegetable oils such as jojoba, soybean, rice bran, avocado, almond, olive, sesame, persic, castor, coconut; fats such as beef tallow, lard and hardened oils obtained by hydrogenating the aforementioned oils; synthetic mono-, di- and tri-glycerides such as myristic acid glyceride and 2-ethylhexanoic acid glyceride; waxes such as carnuba, spermaceti, beeswax, lanolin and derivatives thereof; and hydrocarbons such as liquid paraffins, petrolatum, microcrystalline wax, ceresin, squalene, squalane, mineral oil, and polyethylene. As necessary, the one or more hydrocarbon-containing oils may be modified via known techniques to facilitate cross-linking by the selected cross-linking agent or agents. For example, where such hydrocarbon-containing oils lack acid or base functionality, it is contemplated by the present invention that such functionality may be impaired by conventional techniques, for instance by blowing/oxidizing in the case of imparting acid functionality.

Other suitable hydrocarbon-containing oils may include, without limitation, organosilicone copolymers having Si—H functionality, such as methylalkylaryl organosilicone coplymers having Si—H functionality, which compounds have been found to be cross-linked by water, at an elevated pH, to form a gelled polymer.

A suitable emulsification technique used in the following examples is to combine about 10% of a tridecyl alcohol ethoxylate with a small amount of water, and add the oil blend to be emulsified with vigorous mixing to form a thick paste, then slowly add the remaining water to obtain a stable emulsion. However, it is to be understood that the present invention is not limited by the particular emulsification technique employed, and any emulsion technique and emulsifier selection that is effective in emulsifying the constituents of the present invention may be used.

The present invention is best understood with reference to the below examples. However, it is to be understood that these examples are provided for illustrative purposes only and are not to be construed as limiting the scope of the present invention.

EXAMPLE 1

The following ingredients were added to a 5 liter flask:

400 g of a paintable silicone fluid, commercially available from GENESEE POLYMERS CORPORATION in Flint, Mich. under the tradename GP-70-S PAINTABLE SILICONE FLUID, comprising a 40 chain siloxane with methyl, dodecyl and 2-phenyl propyl groups;

400 g ethyl silicate, and 1 g KOH dissolved in 5 g ethanol.

The flask was then heated to 110–120° C. for 2 hours, and subsequently cooled to below 80° C., after which 400 g DAMO was slowly added. This mixture was thereafter heated to 110–120° C. for 2 hours and then cooled. The resultant composition was labeled DES-70.

Thereafter, the following ingredients were added into a laboratory-scale high-energy mixer driven by a drill press:

20 g of a tridecyl alcohol ethoxylate emulsifier, commercially available from GENESEE POLYMERS CORPORATION under the tradename GP-644 EMULSIFIER BLEND; and 13.2 g soft water.

This was mixed until a thick paste was formed. Then to the paste was added a blend of the following 12 g DES-70, prepared as described above, and 188 g blown soybean oil, commercially available from WERNER G. SMITH, INC. in Cleveland, Ohio, under the tradename BLOWN SOYA Z2-Z4.

Mixing was subsequently continued for approximately 3 minutes. Then 316.8 g soft water was added to the mixture over approximately 3 minutes.

The resulting product was allowed to stand at room temperature (approximately 25° C.) for 24 hours.

Subsequent analysis showed a high quality wetting composition was obtained comprising a dispersed phase in the form of a gelled material. The composition was of approximately 40% non-volatile content.

In this and other examples, as indicated, wetting tests were conducted by heating mold-grade steel to a desired temperature and subsequently spraying a controlled quantity of the tested composition onto the mold surface. Each tested composition was diluted with soft water to a 0.5% active solution. A three second spray from a paint sprayer was applied to a spot on the mold-grade steel. After this application, the wetting efficiency was gauged by evaluating the diameter and apparent thickness of the film created by the composition. Multiple formulations were tested at the same time, and evaluations made comparatively.

Exemplary compositions of the current invention were also tested against a paintable silicone emulsion, with results as indicated.

In the current example, wetting tests demonstrated greatly improved wetting and deposition of active ingredient on surfaces heated to approximately 600° F., as compared to emulsions of uncross-linked blown soybean oil.

EXAMPLE 2

The following ingredients were added to a 5 liter flask:

800 g GP-70-S PAINTABLE SILICONE FLUID;

200 g ethyl silicate; and 1 g KOH dissolved in 5 g ethanol.

The flask was heated to 110–120° C. for one hour, and thereafter cooled to below 80° C. Then 200 g DAMO was slowly added, and the resultant mixture heated to 110–120° C. for 2 hours and then cooled. The resultant composition was labeled AES-70.

Thereafter, the following ingredients were added into a laboratory-scale high-energy mixer driven by a drill press:

20 g GP-644 EMULSIFIER BLEND, referenced above; and 13.2 g soft water.

The foregoing was mixed until a thick paste was formed, to which paste was added a blend of:

12 g AES-70, prepared as described above; and 188 g BLOWN SOYA Z2-Z4.

Mixing was continued for approximately 3 minutes, after which 316.8 g soft water was added over an approximately 3 minute period.

The resulting product was allowed to stand at room temperature (approximately 25° C.) for 24 hours.

A high quality wetting composition was obtained of approximately 40% non volatile content. Wetting tests demonstrated greatly improved wetting at temperatures above 600° F.

EXAMPLE 3

The following ingredients were added to a 5 liter flask:

900 g ethyl silicate 40 (40% condensed ethyl silicate);

300 g DAMO; and 1 g KOH dissolved in 5 g ethanol/

The flask was heated to 130° C. for 3 hours, and then cooled. The resultant composition was labeled DES-40.

Thereafter, the following ingredients were added into a laboratory-scale high-energy mixer driven by a drill press:

20 g GP-644 EMULSIFIER BLEND; and 13.2 g soft water.

The foregoing was mixed to form a thick paste, to which paste was added a blend of the following:

16 g DES-40, prepared as described above; and 184 g BLOWN SOYA Z2-Z4

Mixing was thereafter continued for approximately 3 minutes. Then 316.8 g soft water was added over an approximately 3 minute period.

The resulting product was allowed to stand at room temperature (approximately 25° C.) for 24 hours.

A high quality wetting composition was obtained of approximately 40% non-volatile content. Wetting tests demonstrated greatly improved wetting at temperatures above 600° F.

EXAMPLE 4

The following ingredients were added laboratory-scale high-energy mixer driven by a drill press:

20 g GP-644 EMULSIFIER BLEND; and 13.2 g soft water.

The foregoing was mixed to form a thick paste, to which paste was added a blend of the following:

4 g DAMO; and 196 g blown canola oil, commercially available from WERNER G. SMITH, INC. in Cleveland, Ohio under the tradename BLOWN CANOLA Z2.

The admixture was mixed for approximately 3 minutes, after which 316.8 g soft water was added over an approximately 3 minute period while mixing continued.

The resulting product was allowed to stand at room temperature (approximately 25° C.) for 24 hours.

A high quality wetting composition was obtained of approximately 40% non-volatile content. Wetting tests demonstrated greatly improved wetting at temperatures above 600° F.

EXAMPLE 5

The following ingredients were added laboratory-scale high-energy mixer driven by a drill press:

10 g GP-644 EMULSIFIER BLEND; and 6.6 g soft water.

The foregoing was mixed to form a thick paste, to which paste was added a blend of the following:

0.5 g DAMO; and 99.5 g blown castor oil, commercially available from CASCHEM, INC. in Bayonne, N.J. under the trade name #40 OIL.

The admixture was mixed for approximately 3 minutes, after which 316.8 g soft water was added over an approximately 3 minute period while mixing continued.

The resulting product was allowed to stand at room temperature (approximately 25° C.) for 24 hours.

A high quality wetting composition was obtained of approximately 40% non-volatile content. Wetting tests demonstrated greatly improved wetting at temperatures above 600° F.

EXAMPLE 6

The following ingredients were added laboratory-scale high-energy mixer driven by a drill press:

20 g GP-644 EMULSIFIER BLEND; and 13.2 g soft water.

The foregoing was mixed to form a thick paste, to which paste was added a blend of the following 4 g DAMO, and 196 g BLOWN SOYA Z2-Z4.

The admixture was mixed for approximately 3 minutes, after which 316.8 g soft water was added over an approximately 3 minute period while mixing continued.

The resulting product was allowed to stand at room temperature (approximately 25° C.) for 24 hours.

A high quality wetting composition was obtained of approximately 40% non-volatile content. Wetting tests demonstrated greatly improved wetting at temperatures above 600° F.

EXAMPLE 7

An emulsion comprising a blown soybean oil/DAMO blend made according to the present invention blended about 50/50 with an emulsion of a heavy naphthenic oil has shown particular, though not exclusive, utility as a plunger lubricant. Such an emulsion was prepared by admixing the following:

70 parts emulsion as prepared in Example 6;

28 parts thick napthenic oil emulsion; and 2 parts emulsion of 70 sus white oil.

All emulsions were 40% active in water.

EXAMPLE 8

23 7 g GP-644 EMULSIFIER BLEND and 20.1 g distilled water were slowly mixed to form a thick, grease-like paste.

Thereafter, 177.4 g dehydrated castor oil, commercially available under the tradename CASTUNG 403 Z-3 from CASCHEM, INC in Bayonne, N.J., and 6.0 g benzoyl peroxide (97%), commercially available from SIGMA-ALDRICH CHEMICALS, were mixed in a high-speed malt mixer. With continuous mixing, the resultant admixture was slowly added to the water and emulsifier composition, along with some of 271.53 g of distilled water as necessary to maintain the grease-like consistency of the paste. Following combination of the castor oil/benzoyl peroxide mixture to the water/emulsifier composition, mixing continued at high speed for a further 10 minutes. The mixture was subsequently combined with the remaining quantity of the original 271.53 g distilled water and sheared to a high-quality emulsion using a malt mixer. The resultant emulsion was aged for three days at room temperature, following which 0.6 g ONYXIDE200 (Hexahydro-1,3,5-tris(2-hydroxyethyl)-S-triazine), an anti-bacterial agent commercially available from STEPAN COMPANY of Northfield, Ill., was mixed with the emulsion.

A portion of the thus-prepared emulsion was poured into an aluminum weighing dish and placed on a 250° F. hot plate for 30 minutes to yield a gelled material with rubber-like consistency.

A further portion of the emulsion was heated at 60° C. for approximately 64 hours and thereafter cooled to room temperature. After cooling, a portion of the thus-prepared emulsion was poured into an aluminum weighing dish and placed on a 250° F. hot plate for 30 minutes to yield a loosely-gelled material.

Yet another portion of the emulsion was placed in an Erlenmeyer flask to which was attached a thermometer and cold-water reflux condenser. With continuous stirring, the emulsion was subsequently heated to 90° C., at which temperature the emulsion was maintained for a further 4 hours. Following this heating step, the emulsion was cooled to room temperature and a small quantity was heated at 250° F. for 30 minutes to form a softly-gelled residue.

This example demonstrates the hydrocarbon-containing oils may be cross-linked by peroxides, including benzoyl peroxide, through mechanism of peroxide radical formation. Radical formation may, as desired, be accelerated by heating the emulsion.

EXAMPLE 9

To prepare an emulsion comprising castor oil and an organosilicone copolymer, 9 1 g GP-644 EMULSIFIER BLEND and 9.2 g distilled water were slowly mixed to form a thick, grease-like paste. Thereafter, 17 9 g of a methylalkylaryl organosilicone copolymer containing reactive Si—H functionality, commercially available from GENESEE POLYMERS CORPORATION under the trade name GP-664, and 161.1 g dehydrated castor oil (CASTUNG 403 Z-3) were mixed in a separate container. With continuous mixing, the resultant organosilicone copolymer/castor oil admixture was slowly added to the water and emulsifier composition, along with some of 154.2 g of distilled water as necessary to maintain the grease-like consistency of the paste, as well as approximately 0 10 g of a 5% (be weight) solution of chloroplatinic acid in isoproanol, commercially available from GENESEE POLYMERS CORPORATION under the trade name GP-389. The mixture was subsequently combined with the remaining quantity of the original 154.2 g distilled water and sheared in a malt mixer to form a high-quality emulsion.

A portion of the thus-formed emulsion was transferred to a shell vial, which vial was partially submerged in a 60° C. oil bath for approximately 18–20 hours. The emulsion was subsequently cooled to room temperature and a small quantity was thereafter heated on a 250° F. hot plate for 90 minutes, yielding a gelled, rubber-like residue.

The foregoing example demonstrates that hydrocarbon-containing oils may be cross-linked by organosilicone copolymers having Si—H functionality, including methylalkylaryl organosilicone copolymers with Si—H functionality. Without being bound to any particular theory, it is believed that the cross-linking is achieved by the catalysis of a hydrosilation 11) reaction between the Si—H in the organosilicone copolymer and double-bonded carbon in the dehydrated castor oil.

EXAMPLE 10

23.7 g GP-644 EMULSIFIER BLEND and 20.1 g distilled water were slowly mixed to form a thick, grease-like paste.

Thereafter, 177.4 g BLOWN SOYA Z2-Z4 and 6.0 g AMMO were mixed in a high-speed malt mixer. With continuous mixing, the resultant admixture was slowly added to the water/emulsifier composition, along with some of 271.53 g of distilled water as necessary to maintain the grease-like consistency of the paste. Following mixing at high speed for 10 minutes, the resultant admixture was combined with the remaining quantity of the original 271 53 g distilled water and sheared in a malt mixer to form a high-quality emulsion. The resultant emulsion was aged for three days at room temperature, following which 0 6 g ONYXIDE200 was mixed with the emulsion.

The thus-prepared emulsion was aged for approximately 16 hours at room temperature, after which a portion of the emulsion was placed in an aluminum weighing dish and heated on a 250° F. hot plate for 20 minutes to yield a tightly-gelled, rubber-like solid having a non-volatiles content of approximately 38%.

EXAMPLE 11

The methodology of Example 10 was repeated with the exception that 6.0 g AMEO was substituted for the AMMO of the prior example. Following heating of a portion of the emulsion at 250° F. for 20 minutes, a loosely-gelled, rubber-like solid was produced having a non-volatiles content of approximately 37%.

EXAMPLE 12

The following ingredients were added to a 5 liter flask:

800 g GP-70-S PAINTABLE SILICONE FLUID;

200 g ethyl silicate; and 1 g KOH dissolved in 5 g ethanol.

The flask was heated to 110–120° C. for one hour, and thereafter cooled to below 80° C. Then 200 g AMEO was slowly added, and the resultant mixture heated to 110–120° C. for 2 hours and then cooled.

Thereafter, the following ingredients were added into a laboratory-scale high-energy mixer driven by a drill press:

20 g GP-644 EMULSIFIER BLEND; and 13.2 g soft water.

The foregoing was mixed until a thick paste was formed, to which paste was added a blend of:

12 g of the AMEO/GP-70-S/ethyl silicate, prepared as described above; and 188 g BLOWN SOYA Z2-Z4.

Mixing was continued for approximately 3 minutes, after which 316.8 g soft water was added over an approximately 3 minute period.

Gelling took place at ambient conditions. After aging for approximately five days, the thus-prepared emulsion yielded a gelled residue.

The above examples demonstrate that a wetting-composition exhibiting improved high-temperature wetting performance can be prepared from one or more hydrocarbon-containing oils and one or more cross-linking agents having at least one functional group, including, without limitation, cross-linking agents selected from the group consisting of peroxides, silicates, siloxanes, silanes, hydrocarbon-containing oils, and mixtures thereof. As mentioned hereinabove, the present invention has several advantages over the current art. First, the cost of producing the composition of the current invention is exceptionally low, particularly as hydrocarbon-containing oils are inexpensive and readily available. And while the cross-linking agents employed are relatively more expensive, they may be used as a small percentage of the oil or oils. Another advantage of the present invention is that the composition thereof is extremely thick and viscuous, by virtue of which it has shown effectiveness as a thickener for conventional oils when blended with emulsions thereof. Moreover, the high-temperature stability demonstrated by the composition of the instant invention makes it suitable for use as a quenching agent.

Of course, the foregoing are merely illustrative of the present invention, those of ordinary skill in the art will appreciate that many additions and modifications to the present invention, as set out in this disclosure, are possible without departing from the spirit and broader aspects of this invention as defined in the appended claims.

The invention claimed is:

1. An aqueous carrier having dispersed therein a gelled polymer comprising one or more unsaturated hydrocarbon-containing oils cross-linked by hydrosilation reactions with one or more cross-linking agents characterized by Si—H functionality.

2. The composition of claim 1, wherein the one or more unsaturated hydrocarbon-containing oils are selected from the group consisting of vegetable oils and derivatives thereof having acid or base functionality imparted thereto.

3. The composition of claim 2, wherein the one or more cross-linking agents comprises an organosilicone copolymer with Si—H functionality.

4. The composition of claim 3, wherein the one or more unsaturated hydrocarbon-containing oils comprises dehydrated castor oil.

5. The composition of claim 4, wherein the one or more cross-linking agents comprises an organosilicone copolymer having greater than one Si—H functionality per molecule.

6. The composition of claim 5, wherein the one or more cross-linking agents comprises a methylalkylaryl organosilicone copolymer having Si—H functionality.

7. An aqueous carrier having dispersed therein a gelled polymer comprising an unsaturated vegetable oil or derivative thereof which is cross-linked by hydrosilation reactions with a cross-linking agent characterized by Si—H functionality.

8. The composition of claim 7, wherein the cross-linking agent is an organosilicone copolymer having Si—H functionality.

9. The composition of claim 8, wherein the unsaturated vegetable oil or derivative thereof is dehydrated castor oil.

10. The composition of claim 9, wherein the cross-linking agent is an organosilicone copolymer having greater than one Si—H functionality per molecule.

11. The composition of claim 10, wherein the cross-linking agent is a methylalkylaryl organosilicone copolymer having Si—H functionality.

12. A method of preparing a composition comprising an aqueous carrier having dispersed therein a gelled polymer, the method comprising the steps of:

Providing one or more unsaturated hydrocarbon-containing oils;

Providing one or more cross-linking agents characterized by Si—H functionality;

Mixing the one or more unsaturated, hydrocarbon-containing oils and the one or more cross-linking agents;

Emulsifying the mixture of the one or more unsaturated, hydrocarbon-containing oils and the one or more cross-linking agents in an aqueous carrier in the presence of a catalyst to promote the formation of the gelled polymer through the cross-linking of the one or more unsaturated, hydrocarbon-containing oils by hydrosilation reactions with the one or more cross-linking agents.

13. The method of claim 12, wherein the one or more unsaturated hydrocarbon-containing oils are selected from the group consisting of vegetable oils and derivatives thereof having acid or base functionality imparted thereto.

14. The method of claim 13, wherein the one or more cross-linking agents comprise an organosilicone copolymer with Si—H functionality.

15. The method of claim 14, wherein the one or more unsaturated hydrocarbon-containing oils comprises dehydrated castor oil.

16. The method of claim 15, wherein the cross-linking agent comprises an organosilicone copolymer having greater than one Si—H functionality per molecule.

17. The method of claim 16, wherein the one or more cross-linking agents comprises a methylalkylaryl organosilicone copolymer having Si—H functionality.

18. The method of claim 17, wherein the catalyst comprises a precious metal salt.

19. The method of claim 18, wherein the catalyst comprises chloroplatinic acid.

20. The method of claim 13, wherein the one or more unsaturated hydrocarbon-containing oils is castor oil, and the one or more cross-linking agents is an organosilicone copolymer having greater than one Si—H functionality per molecule.

21. The method of claim 20, wherein the one or more cross-linking agents is a methylalkylaryl organosilicone copolymer having Si—H functionality.

22. The method of claim 21, wherein the catalyst is a precious metal salt.

23. The method of claim 22, wherein the catalyst is chloroplatinic acid.

* * * * *

UNITED STATES PATENT AND TRADEMARK OFFICE

CERTIFICATE OF CORRECTION

PATENT NO. : 7,030,066 B1
APPLICATION NO. : 10/292918
DATED : April 18, 2006
INVENTOR(S) : Piskoti It is certified that error appears in the above-identified patent and that said Letters Patent is hereby corrected as shown below:

Column 2, line 22, delete “is” and insert - - in - -;

Column 2, line 53, delete “coplymers” and insert - - copolymers - -;

Column 3, lines 8-9, delete “speimaceti” and insert - - spermaceti - -;

Column 4, line 46, delete “coplymers” and insert - - copolymers”- -;

Column 5, line 11, delete “impaired” and insert - - imparted - -;

Column 8, line 29, delete “23 7 g” and insert - - 23.7g - -;

Column 9, line 12, delete “9 1 g” and insert - -9.1g - -;

Column 9, line 14, delete “17 9 g” and insert - - 17.9g - -;

Column 9, line 24, delete “0 10 g” and insert - - 0.10g - -;

Column 9, line 43, delete “11)”;

Column 10, line 56, delete “viscuous” and insert - - viscous - -.

Signed and Sealed this

Fifteenth Day of August, 2006

JON W. DUDAS
*Director of the United States Patent and Trademark Office*